US009511618B2

(12) United States Patent
Pesce

(10) Patent No.: US 9,511,618 B2
(45) Date of Patent: Dec. 6, 2016

(54) WRITING INSTRUMENT ADAPTED TO DISPENSE NOTE PAPER

(76) Inventor: Frerderick Pesce, New Hartford, CT (US)

( * ) Notice: Subject to any disclaimer, the term of this patent is extended or adjusted under 35 U.S.C. 154(b) by 536 days.

(21) Appl. No.: 11/897,615

(22) Filed: Aug. 31, 2007

(65) Prior Publication Data

US 2009/0060626 A1 Mar. 5, 2009

(51) Int. Cl.
*B43K 29/00* (2006.01)
*B43K 29/12* (2006.01)

(52) U.S. Cl.
CPC ..... *B43K 29/12* (2013.01)

(58) Field of Classification Search
CPC ..... B43K 29/12
USPC ..... 401/195, 52; 206/389, 409
See application file for complete search history.

(56) References Cited

U.S. PATENT DOCUMENTS

| | | | | |
|---|---|---|---|---|
| 700,803 | A * | 5/1902 | Orlansky | 401/195 |
| 2,073,719 | A * | 3/1937 | Ross | 401/195 |
| 4,963,048 | A * | 10/1990 | Thomas et al. | 401/195 |
| 4,989,801 | A * | 2/1991 | Thomas et al. | 401/195 |
| 7,322,766 | B2 * | 1/2008 | Erlebacher et al. | 401/195 |
| 7,431,526 | B2 * | 10/2008 | Lin | 401/195 |
| 2006/0019050 | A1 * | 1/2006 | Gilmer | 428/40.1 |

* cited by examiner

*Primary Examiner* — Jennifer C Chiang
(74) *Attorney, Agent, or Firm* — Steven M. McHugh

(57) ABSTRACT

A note paper dispensing writing instrument having inner and outer tubular shells telescopically assembled with a partially coiled pad of paper inserted within the inner shell. Axial aligned slots in the shells receive free edges of the paper projecting therethrough in fanned relationship. The opposite edges of the paper being lightly glued together. An elongated member in the center of the coil is flexed to engage a sheet of paper being withdrawn and aids in detaching the paper at its glued edge.

7 Claims, 2 Drawing Sheets

WRITING INSTRUMENT ADAPTED TO DISPENSE NOTE PAPER

BACKGROUND OF THE INVENTION

Combined pen and paper dispensing devices are known in the patented art and available in the marketplace, but are not wholly satisfactory.

It is the general object of the present invention to provide a note paper dispensing writing instrument of desirably simply construction which can be manufactured at economic advantage and which is highly efficient in use.

SUMMARY OF THE INVENTION

In fulfillment of the foregoing object and in accordance with the present invention, an improved writing instrument adapted to dispense note paper comprises a first hollow tubular shell open at one end and partially closed at the opposite end with a small axially extended opening therethrough. The shell also has an outwardly open axially extending slot along its sidewall. A writing instrument has an operative end adapted to project from the end of the small axial opening and an associated elongated member of small diameter extending through said opening and projecting substantially into the interior of the shell. A small pad of note paper is provided with a plurality of sheets of paper successively glued together along one edge. The pad is partially coiled upon itself with the glued together sheets facing inwardly and inserted axially into the interior of the shell. The free ends of the sheets of paper project outwardly through the axial slot of the shell in a fanned slightly spaced relationship so as to be grasped manually by the user. The relative dimensions of the shell diameter and the coiled pad are such that the coil opens slightly within the shell interior without overlap between the free edges of the sheets of paper and the glued together opposite edges of the paper. Thus, the note paper is readily removable from the interior of the shell one sheet at a time by manually grasping and withdrawing the free edge of the innermost sheet of paper.

Preferably, the elongated member associated with the writing instrument is flexible so as to be engaged by a sheet of paper as it withdrawn from the pad of paper and caused to flex radially thereby so as to exert a reactive force on a sheet of paper tending to separate the same along its glued edge from the next adjacent sheet of paper on the pad. A conventional refill may be employed with a writing instrument at one end and an elongated flexible ink reservoir attached thereto.

Preferably, a second hollow tubular shell is provided and is slightly larger in diameter than said first shell so as to be telescopically assembled thereabout. The second shell also has an axially extending open slot in its sidewall and is open at least at one end to accommodate the aforesaid telescopic assembly. With the axial slots in the two shells radially aligned, the free edge portions of the sheets of paper project outwardly therethrough in fanned relationship. Optionally, the slot in the outer shell may be substantially wider than the slot in the inner shell with the two shells relatively rotatable between open and closed positions, the fanned edges of the note paper being exposed through both slots in the open position and covered by the outer shell in the closed position.

Finally, rough generally radially surfaces are provided in axially spaced relationship for engagement with opposite end portions of the partially coiled pad of paper to provide frictional retention preventing more than one sheet of paper being withdrawn at a time.

DESCRIPTION OF THE PREFERRED EMBODIMENTS

Figure 1:
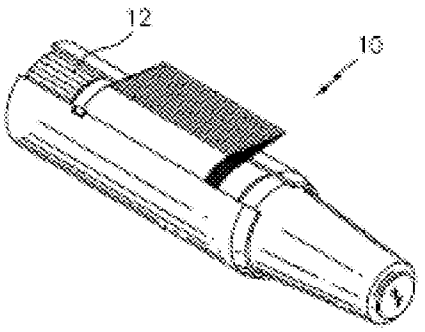
FIG. 1 is an assembled view of the writing instrument of the invention in open position with an end cap removed.
Figure 2:
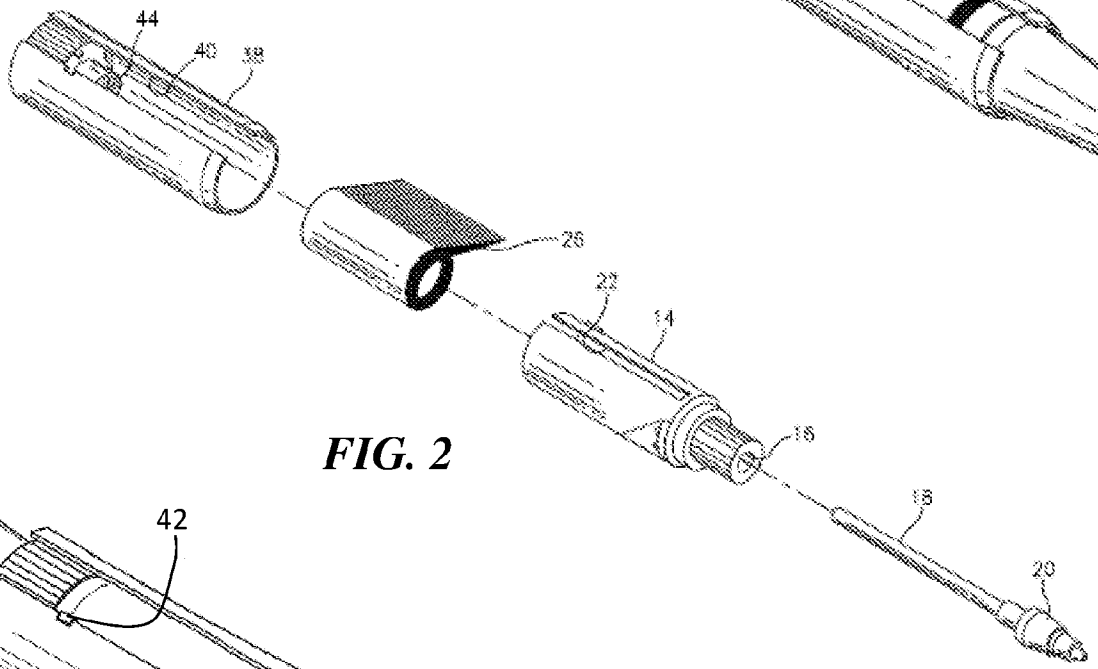
FIG. 2 is an exploded perspective view of the writing instrument of FIG. 1.

Referring particularly to FIG. 1, a writing instrument in accordance with present invention is indicated generally at 10 with a series of sheets of paper in a fanned arrangement for withdrawal of individual sheets from the interior of the instrument. A first or inner tubular shell 14, best illustrated in FIG. 2, is open at one end and partially closed at the opposite end with a small axial opening 16 communicating with the interior of the shell. Writing instrument 18 has an elongated member 20 which may comprise a flexible ink reservoir for the writing instrument. Member 20 is inserted through the opening 16 and reside within the shell 14 in operative relationship with the pad of paper 12 as will be explained more here and below. The edges of the paper 12 project in fanned relationship through an axially elongated slot 22 in the shell 14. Preferably and as shown, the shell 14 carries a boss adjacent the writing instrument 18, FIGS. 1 and 3, for ease in manual manipulation by the user of the instrument.

As will be apparent, the writing instrument may also include a pencil of appropriate design which is inserted into the opening 16 with an upper end portion disposed within the interior of the shell 14.

Figure 7:
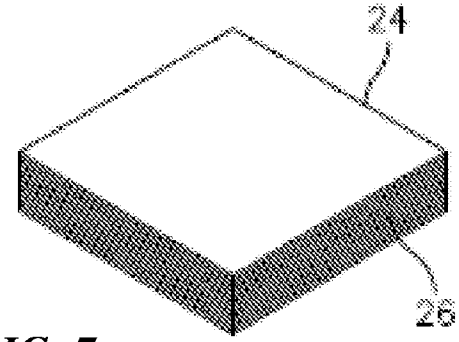
FIG. 7 is a perspective view of a small pad of note paper useable with the writing instrument

A small pad of note paper is illustrated in its flat condition in FIG. 7 at 24. The pad employed in the writing instrument of the present invention is approximately 2 inches by 2 inches with a glue zone indicated at 26 along one edge thereof. That is, the individual sheets are lightly glued together at 26 so as to be withdrawn with minimal force by the user.

Figure 8:
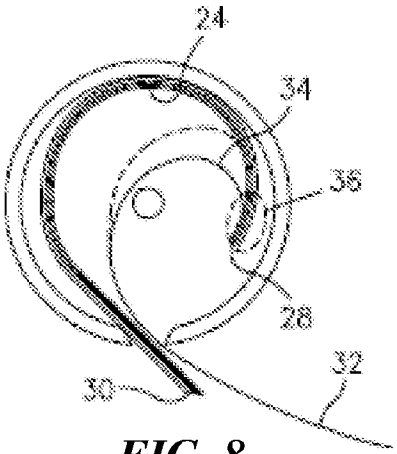
FIG. 8 is an enlarged view of an inner shell of the instrument with the note paper partially coiled upon itself and disposed within the interior of the shell.
Figure 4:
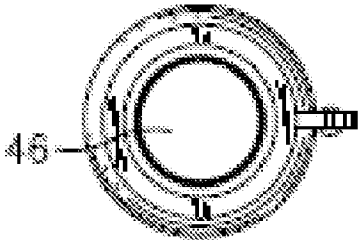
FIG. 4 is a top view.

Returning to FIG. 2, the pad 24 is coiled upon itself and the edges thereof may overlap slightly as shown at 26. The partially coiled pad is then inserted axially to a position within the inner shell 14 as illustrated in FIG. 8. That is, the coil springs open slightly with one edge of the pad at 28 and with an opposite edge projecting through the slot 22. The individual sheets of paper assume a fanned relationship at 30 resulting from the partial coiling of the pad. Thus, an innermost sheet of paper 32 may be grasped by the user and withdrawn from the interior of the shell 14 through the slot 22. At the end of the withdrawal action, the edge of the paper at 34 pulls away from the next adjacent sheet of paper and the glue therebetween at the glue zone 26.

Preferably, and is best illustrated at FIG. 8, the ink reservoir 20 or portion of a pencil serves a function in the withdrawal of paper from the interior if the shell as shown in FIG. 8. The member 20 is centrally located in its relaxed or normal position. During withdrawal of a sheet of paper such as 32 the member 20 is engaged by the sheet of paper and at least an upper end portion thereof is flexed. In this position, the member exerts a reactive force against the paper during withdrawal which aids in the removable of the paper and particularly in the detachment of the sheet 32 from its next adjacent sheet and the adhesive at the glue zone 26.

Figure 3:
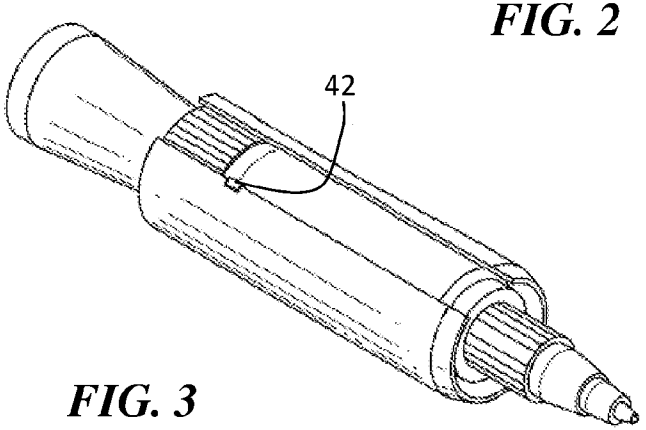
FIG. 3 is a fully assembled view of the writing instrument closed position with an end cap in place.
Figure 6:
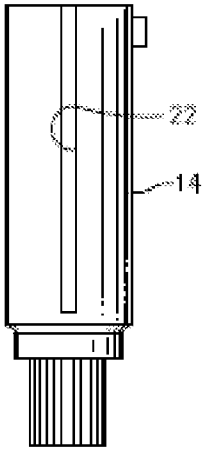
FIG. 6 is a side view of an inner shell.
Figure 5:
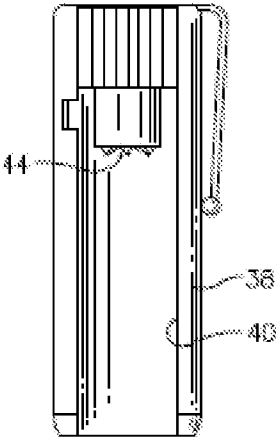
FIG. 5 is a side view of an outer shell partially broken away.

Reverting to FIG. 2, a second or outer tubular shell is illustrated at 38 and is slightly larger than the shell 14 in diameter so as to be telescopically assembled therewith as shown in FIGS. 1 and 3. The second shell 38 also has an elongated axial slot 40 which opens outwardly and which is substantially wider than the slot 22 in the shell 14. In the assembled relationship of FIGS. 1 and 3 the shell 38 is rotatable relative to the shell 22 between the open position of FIG. 1 and the closed position of FIG. 3. A small stop 42 establishes the closed position.

Finally, axially spaced rough surfaces 44 and 46 are formed respectively in an outer shell 38 and the inner shell 14 and engage opposite ends of the partially coiled note paper to provide a frictional force tending to retain the paper in the shells against unintended or accidental withdrawal.

As will be apparent form the foregoing, the construction of the note paper dispensing writing instrument of the invention is relatively simple; conducive to low cost manufacture. In operation, the instrument is highly efficient with individual sheets of paper manually withdrawn in a simple motion between the users fingers and with the remaining sheets of paper on the pad remaining within the interior of the shells. Loading of readily available partially coiled pads is a simple matter involving only, a relative axial movement between the partially coiled pad and the inner shell.

The invention claimed is:

1. A writing instrument adapted to dispense note paper comprising a first hollow tubular shell open at one end and partially closed at the other end with a small axial opening therethrough, said shell also having an outwardly open axially extending slot along a side wall, a writing instrument having an operative end adapted to project from the end of the small opening and an associated elongated member of small diameter extending through said opening and substantially into the interior of the shell, and a small pad of notepaper comprising a plurality of sheets of paper successively glued together along one edge, said pad being partially coiled upon itself with glued together sheets facing inwardly and inserted axially into the interior of said shell with free ends of the sheets of paper projecting outwardly through said slot in a fanned slightly spaced relationship so as to be grasped manually by the user, the relative dimensions of the shell diameter and the coiled pad being such that the coil pad opens slightly in the shell interior without overlap between the free edges of the sheets of paper and the glued together opposite edges of the paper, the note paper thus being removable from the interior of the shell one sheet at a time by manually grasping and withdrawing the free edge of the innermost sheet of paper.

2. A note paper dispensing writing instrument as set forth in claim 1 wherein said elongated member is flexible and is engaged by a sheet of paper being withdrawn from the pad of paper and caused to flex thereby so as to exert a reactive force tending to separate the sheet of paper along its glued edge from the next adjacent sheet of paper on the pad.

3. A note paper dispensing writing instrument as set forth in claim 1 wherein the writing instrument takes the form of a pen with the elongated member bring a flexible ink reservoir.

4. A note paper dispensing writing instrument as set forth in claim 1 wherein the writing instrument takes the form of a pencil.

5. A note paper dispensing writing instrument as set forth in claim 1 wherein a second hollow tubular shell is provided and is slightly larger in diameter than said first shell so as to be telescopically assembled about the former, the second shell also having an axially extending slot in its side wall and being open at least at one end to accommodate the aforesaid telescopic assembly, the free edge portions of the sheets of paper projecting outwardly through both slots when they are aligned radially.

6. A note paper dispensing writing instrument as set forth in claim 5 wherein the two shells are relatively rotatable with a stop provided for limiting rotation in one direction with the free end portions of the paper exposed and in an opposite direction with said portions covered by the outer shell.

7. A note paper dispensing writing instrument as set forth in claim 5 wherein rough generally radial surfaces are provided in the two shells in axially spaced relationship for engagement with opposite end portions of the pad of paper to provide frictional retention, preventing more than one sheet of paper being withdrawn at a time.

* * * * *